US008475742B2

(12) United States Patent
Suto et al.

(10) Patent No.: US 8,475,742 B2
(45) Date of Patent: Jul. 2, 2013

(54) BLOOD SERUM OR BLOOD PLASMA SEPARATING MATERIAL AND BLOOD-COLLECTING TUBE USING SAME

(75) Inventors: Kunihiro Suto, Ibaraki (JP); Yasushi Kojima, Ibaraki (JP)

(73) Assignee: Hitachi Chemical Co., Ltd., Tokyo (JP)

( * ) Notice: Subject to any disclaimer, the term of this patent is extended or adjusted under 35 U.S.C. 154(b) by 0 days.

(21) Appl. No.: 13/128,137

(22) PCT Filed: Nov. 9, 2009

(86) PCT No.: PCT/JP2009/069061

§ 371 (c)(1),
(2), (4) Date: Jun. 10, 2011

(87) PCT Pub. No.: WO2010/053180

PCT Pub. Date: May 14, 2010

(65) Prior Publication Data

US 2011/0250105 A1 Oct. 13, 2011

(30) Foreign Application Priority Data

Nov. 7, 2008 (JP) ..... 2008-286433

(51) Int. Cl.
*B01L 3/14* (2006.01)
*B01L 3/00* (2006.01)

(52) U.S. Cl.
USPC ..... 422/527; 422/500; 422/50

(58) Field of Classification Search
USPC ..... 422/527, 500, 50; 528/10; 525/477, 525/474, 50
See application file for complete search history.

(56) References Cited

U.S. PATENT DOCUMENTS 3,780,935 A * 12/1973 Lukacs et al. ..... 494/37
4,043,928 A 8/1977 Lukacs et al.

(Continued)

FOREIGN PATENT DOCUMENTS

CN 1281145 1/2001
CN 1878594 12/2006

OTHER PUBLICATIONS

Tameyasu, T.; Naokata Ishii, N.; Noboru Oishi, N.; Shimada, M.; Shirakawa, I; Akimoto, T.; Yamamoto, N.; Kosuge, S., Sugi, H. "Steady-state force—velocity relation of ATP-dependent sliding between slime mold myosin, arranged on paramyosin filaments, and algal cell actin cables," Comparative Biochemistry and Physiology Part A 120 (1998) pp. 731-736.*

(Continued)

*Primary Examiner* — Christine T Mui
(74) *Attorney, Agent, or Firm* — Antonelli, Terry, Stout & Kraus, LLP.

(57) ABSTRACT

The present invention relates to a serum or plasma separating material including a moisture curing component having a specific gravity of from 1.03 to 1.09, and a blood collection tube including the serum or plasma separating material. The present invention provides a serum or plasma separating material which is allowed to be present in a cured state between serum or plasma and a blood cell-containing component obtained after centrifugal separation when separating the serum or plasma component in a collection tube, exhibits a good storage stability capable of keeping the serum or the like and the cell-containing component in a separated state in the collection tube for a long period of time, is excellent in stability upon freezing or thawing and upon handling of a sample, and can be cured without need of irradiation with ultraviolet ray or the like, as well as a method of separating serum or plasma using the separating material.

20 Claims, 3 Drawing Sheets

U.S. PATENT DOCUMENTS

| | | | | |
|---|---|---|---|---|
| 4,083,784 | A | 4/1978 | Zine, Jr. | |
| 4,235,725 | A * | 11/1980 | Semersky | 210/516 |
| 4,946,601 | A * | 8/1990 | Fiehler | 210/782 |
| 6,238,578 | B1 * | 5/2001 | Fiehler | 210/787 |
| 2005/0149157 | A1 | 7/2005 | Hunter et al. | |
| 2007/0187341 | A1 | 8/2007 | Emerson | |

OTHER PUBLICATIONS

Brauer, J. R. "Modeling Force Density Distributions on Biomolecular Nanoparticles Undergoing Magnetic Separation," Magnetics Business & Technology magazine, Feb./Mar. 2008, 2 pages.*

Loctite Material Safety Data Sheet, Mar. 29, 2000. 4 pages.*

Communication mailed Dec. 5, 2012, in connection with a European Patent Application No. 09824877.6, European Patent Office, Europe.

Communication mailed Mar. 29, 2013, in connection with a Chinese Patent Application No. 200980144722.1, 7 pages, Chinese Patent Office, Republic of China.

* cited by examiner

BLOOD SERUM OR BLOOD PLASMA SEPARATING MATERIAL AND BLOOD-COLLECTING TUBE USING SAME

TECHNICAL FIELD

The present invention relates to a serum or plasma separating material for separating whole blood into serum or plasma and blood cells, and a blood collection tube using the separating material.

BACKGROUND ART

In inspection or examination for blood components in clinical tests, it is required to separate whole blood into serum or plasma (hereinafter occasionally referred to as "serum or the like") and a component containing blood cells (hereinafter referred to as a "cell-containing component"). As one of the separation methods, there is known the method in which a whole blood sample is collected in a blood collection tube (hereinafter referred to merely as a "collection tube") filled with a material having a specific gravity that is intermediate between those of the serum or the like and the cell-containing component, and the collection tube is subjected to centrifugal separation to place the material at a position between the serum or the like and the cell-containing component to thereby separate both the components from each other. According to the above method, the serum or plasma can be separated and collected using a pipette or by decantation without including blood cells in the serum or the like.

Hitherto, such a serum or plasma separating material is mainly formed of a gel-like material. For example, there has been proposed a serum separating material which contains an α-olefin-maleic acid diester copolymer having a specific viscosity as a main component and whose specific gravity is adjusted to the range of 1.035 to 1.055 (refer to Patent Document 1).

However, when separating the serum or plasma using such a soft gel-like separating material, the serum or the like thus separated in an inspection site tends to subsequently suffer from re-mixing with a cell-containing component owing to vibration upon handling a sample or erroneous absorption of the separating material therein upon dispensing, which will result in failure to obtain correct inspection results. In addition, the gel-like separating material tends to cause inclusion of electrolyte components contained in the blood cells into the serum or the like through an interface between an inner wall of the collection tube and the separating material or through a clearance formed inside of the separating material when stored for a long period of time or when preserved in a frozen state, which also leads to erroneous measurement results.

Also, there has been proposed a blood separating agent containing a polyether polyurethane having specific molecular weight, viscosity and density which is obtained by reacting a polyoxyalkylene glycol having a specific molecular weight with a diisocyanate as a main component, and an inert filler such as silica and alumina (refer to Patent Document 2). The blood separating agent used in Patent Document 2 has a specific gravity (density) which is overlapped with a specific gravity of the separating material of the present invention, and further a functional mechanism of the blood separating agent is similar to that of the present invention in such a point that the blood separating agent is transferred between a serum component and a cell-containing component by centrifugal separation procedure. In Patent Document 2, it is described that the separating agent is composed mainly of the polyether polyurethane as described above and forms a stable barrier upon completion of the centrifugal separation, and the barrier thus formed is not readily broken even when a container filled therewith is inclined or a weak impact is applied to the container, and is free from undesired change even when allowed to stand for a long period of time (column 3, lines 13 to 25 of Patent Document 2). However, even in the method described in Patent Document 2, there tends to still occur such a problem that after stored for a long period of time or preserved in a frozen state, a part of the cell-containing component is re-mixed in the serum component through an interface between an inner wall surface of the collection tube and the separating agent or through a clearance formed inside of the separating agent.

To solve the above conventional problems, there has been proposed the method in which after separating the serum or the like, the separating material is cured by irradiation with ultraviolet ray to completely separate respective components from each other (refer to Patent Documents 3 to 6).

However, it is considered that curing of the separating agent by irradiation with ultraviolet ray might give any adverse influence on measurement of components whose quality tends to be deteriorated by the ultraviolet ray irradiated (for example, bilirubin). In addition, it is usually required to sterilize a collection tube by irradiation with γ-ray, etc., so that the separating material disposed in the collection tube tends to be undesirably cured by the irradiation with γ ray, etc. Therefore, there tends to arise such a problem that the collection tube is incapable of being subjected to sterilization procedure.

On the other hand, in order to avoid undesirable change in quality of the respective components by irradiation with ultraviolet ray, there is known a method of curing the separating material by irradiating a reduced amount of ultraviolet ray thereto. However, since the respective blood components are present on both upper and lower sides of the separating material, the ultraviolet ray irradiated fails to reach a central portion of a resin of the separating material. Thus, it will be difficult to completely cure the resin inclusive of an inside portion thereof in the collection tube. As a result, there also tends to occur such a problem that the cell-containing component is re-mixed in the serum or the like, similarly to the above case where the uncured gel is used as the separating material.

Further, there has been proposed the method in which respective blood components are separated from each other using a porous three-dimensional fluid-transmissive bonded fiber structural body formed of specific polymeric fibers (refer to claims of Patent Document 7). In Patent Document 7, it is described that the structural body has a complicated inside network structure including a plurality of tortuous fluid flow paths through which particles entrained in the fluid are prevented from passing, and therefore serves as an excellent filtering device (refer to paragraph [0031] of Patent Document 7). In addition, Patent Document 7 discloses an elastomer multi-component (ECM) fiber as a specific material, and a thermoplastic elastomer as an example of the elastomer in the ECM fiber (refer to paragraphs [0050] and [0054] of Patent Document 7). However, in the method described in Patent Document 7, the material used therein fails to be transferred to a position between the serum component and the cell-containing component in view of a specific gravity thereof, and it is required that the material is previously disposed at the position by defining a boundary line between plasma and the solid blood component. Therefore, the method of Patent Document 7 needs a complicated procedure and has many problems since the method is not applicable as such to the existing inspection methods using a test tube.

Patent Document 1: Japanese Patent Publication No. S63-48310

Patent Document 2: Japanese Patent Publication No. H1-31588

Patent Document 3: U.S. Pat. No. 6,248,844

Patent Document 4: US. Patent Application Laid-Open No. 2007/187341

Patent Document 5: US. Patent Application Laid-Open No. 2008/108493

Patent Document 6: US. Patent Application Laid-Open No. 2008/132874

Patent Document 7: Published Japanese Translation of PCT Application No. 2008-538087

DISCLOSURE OF THE INVENTION

An object of the present invention is to provide a serum or plasma separating material which is allowed to be present in a cured state between a serum or plasma component and a cell-containing component after being subjected to centrifugal separation upon separating the serum or the like in a collection tube, can exhibit a good storage stability capable of keeping the serum or the like and the cell-containing component in a separated state in the collection tube for a long period of time, is excellent in stability upon freezing or thawing and upon handling of a sample, and can be cured without need of irradiation with ultraviolet ray or the like, as well as a blood collection tube using the separating material.

As a result of intense and extensive researches, the present inventors have found that the above conventional problems can be solved by using a moisture curable component having a particular specific gravity. The present invention has been accomplished on the basis of the finding. Thus, the present invention relates to the following aspects:

(1) a serum or plasma separating material including a moisture curing component having a specific gravity of from 1.03 to 1.09; and (2) a blood collection tube including the serum or plasma separating material as described in the above (1).

When using the serum or plasma separating material according to the present invention, it is possible to obtain a good storage stability capable of keeping the serum or the like and the cell-containing component in a separated state in the collection tube for a long period of time, and an excellent stability upon freezing or thawing and upon handling of the sample. In addition, the serum or plasma separating material can be cured without need of irradiation with ultraviolet ray or the like, so that a blood test can be carried out without adverse influence of the ultraviolet ray, and sterilization by irradiation with γ-ray can be carried out without any inconveniences.

BRIEF DESCRIPTION OF THE DRAWINGS

FIGS. 2-1 to 2-3 are schematic views showing another process for separating the serum or the like and the cell-containing component from each other using the collection tube.

FIGS. 3-1 to 3-3 are schematic views showing a further process for separating the serum or the like and the cell-containing component from each other using the collection tube.

FIGS. 4-1 to 4-3 are schematic views showing the other process for separating the serum or the like and the cell-containing component from each other using the collection tube.

FIGS. 5-1 to 5-3 are schematic views showing the still other process for separating the serum or the like and the cell-containing component from each other using the collection tube.

EXPLANATION OF REFERENCE NUMERALS

Figure 1:
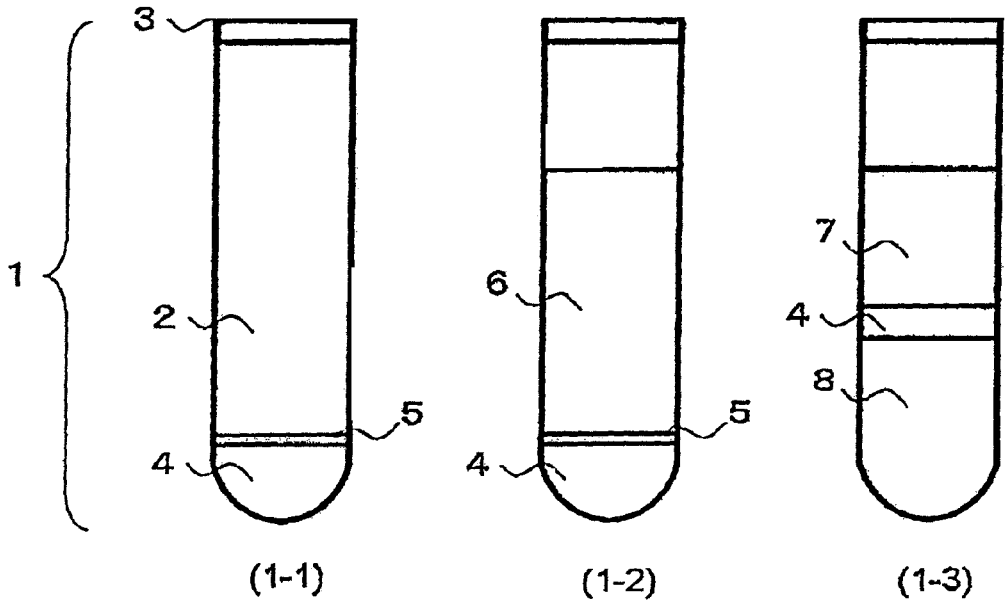
FIGS. 1-1 to 1-3 are schematic views showing a process for separating serum or the like and a cell-containing component from each other using a collection tube.

1: Collection tube; 2: Tube cavity; 3: Lid; 4: Moisture curing component; 5: Blood isolating material; 6: Whole blood; 7: Serum or plasma (serum or the like); 8: Cell-containing component; 9: Capsule; 10: High-specific gravity solid; 11: Container; 12: Lid; 51: Molded article

BEST MODE FOR CARRYING OUT THE INVENTION

The serum or plasma separating material according to the present invention (hereinafter occasionally referred to merely as a "separating material") includes a moisture curing component having a specific gravity of from 1.03 to 1.09.

The serum or plasma separating material according to the present invention is not particularly limited, and any separating material can be used as long as it includes the moisture curing component having a specific gravity of from 1.03 to 1.09. Therefore, the serum or plasma separating material may be constituted of the moisture curing component having a specific gravity of from 1.03 to 1.09 solely, or otherwise may also include the other components. Besides, the serum or plasma separating material may also contain, in addition to the above components, further members such as a capsule and a membrane.

The moisture curing component means a component capable of undergoing a curing reaction in the presence of water. Examples of the moisture curing component include those resins or compounds which contain at least one hydrolyzable reactive group or at least one functional group capable of initiating a reaction thereof by the action of water in a molecule thereof, and undergo initiation of a curing reaction thereof by the action of water in ambient air. In the present invention, the moisture curing component is not particularly limited, and any moisture curing component having the above specific gravity may be used as long as it can initiate a curing reaction thereof by contacting with water in blood. Specific examples of the moisture curing component include a reactive silicone-based compound, an α-cyanoacrylate-based compound, a one-component moisture curing polyurethane resin, a moisture curing epoxy resin and a moisture curing polysulfide resin. Among these moisture curing components, the reactive silicone-based compound, the α-cyanoacrylate-based compound and the one-component moisture curing polyurethane resin are preferably used in view of a high curing rate and a less adverse influence on blood tests, and the reactive silicone-based compound is more preferably used in view of a high bonding property to a wet surface and occurrence of less peel-off from a wall surface upon temperature change, owing to a good elasticity thereof.

Examples of the suitable reactive silicone-based compound include moisture curing silicone resins having a polysiloxane structure in a main chain thereof and containing a reactive group capable of initiating a curing reaction thereof by reacting with water at a terminal end thereof, and modified silicone-based resins in the form of a polymer having, in addition to the polysiloxane structure, a polyether, polyester or poly(meth)acrylic acid ester structure, etc., which contain at least one reactive curing group per a molecule of the polymer. The reactive curing group means a functional group having such a structure capable of forming a silanol group by reacting with water. Examples of the modified silicone-based resins containing such a reactive curing group include dealcoholation type silicone resins, carboxylic acid-desorbing (decarboxylation) type silicone resins such as acetic acid-desorbing (deacetylation) type silicone resins, deoximation type silicone resins, deamidation type silicone resins, deamination type silicones resins and deacetonation type silicone resins, depending upon the kind of group to be desorbed therefrom by the reaction. Among these modified silicone-based resins containing the reactive curing group, preferred are the dealcoholation type silicone resins such as "KANEKA SILYL SAX220" and "KANEKA SILYL SAT400" both available from Kaneka Corp.

Next, typical examples of the suitable α-cyanoacrylate-based compound include those compounds represented by the following general formula (I):

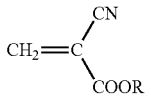

(I)

Examples of the group R in the general formula (I) include alkyl groups such as a methyl group, an ethyl group, an n-propyl group, an n-butyl group, an isobutyl group and an n-pentyl group; alkenyl groups; a cyclohexyl group; aryl groups; and alkoxyalkyl groups.

In general, the α-cyanoacrylate-based compound rapidly initiates anion polymerization in the presence of water as a curing catalyst, so that the curing reaction of the α-cyanoacrylate-based compound proceeds at a very high rate. Therefore, in the case where the α-cyanoacrylate-based compound is used for production of the serum or plasma separating material of the present invention, the time period from completion of the curing reaction to initiation of the centrifugal separation is preferably shortened. In addition, as described hereinafter, it is effective to use such a method in which the α-cyanoacrylate-based compound is prevented from contacting with blood until the centrifugal separation is initiated, using a material for avoiding contact between the compound and the blood (hereinafter referred to as a "blood isolating material").

In addition, when the group R in the general formula (I) is a low molecular weight alkyl group such as a methyl group and an ethyl group, the α-cyanoacrylate-based compound is a low-viscosity liquid and therefore may be difficult to handle as a separating material. For this reason, the α-cyanoacrylate-based compound is preferably adjusted in curing rate and viscosity thereof in order to improve a handling property as a separating material. To suitably adjust the curing rate and viscosity of the α-cyanoacrylate-based compound, there may be used a method of compounding a large amount of the other resin or compound which is inert to the moisture curing reaction of the α-cyanoacrylate-based compound, or a method of using the α-cyanoacrylate-based compound of the general formula (I) in which the group R is a long-chain straight alkyl group or branched alkyl group having 8 or more carbon atoms to enhance a viscosity of the compound or reduce a curing rate thereof. Specific examples of the other resin include poly(meth)acrylic acid esters, polyesters and polyacrylonitrile. Examples of the long-chain alkyl group include an n-octyl group, a lauryl group, a stearyl group and an isostearyl group.

Examples of the one-component moisture curing polyurethane resin include polyisocyanate urethane prepolymers having a plurality of isocyanate groups at a terminal end thereof which are obtained by reacting a polyisocyanate with a polyol, a polyether polyol, a polyhydric phenol or the like. The isocyanate groups are reacted with water while generating a carbon dioxide gas to thereby allow the urethane prepolymers to undergo a crosslinking reaction. Specific examples of the polyisocyanate include aliphatic polyisocyanates such as hexamethylene diisocyanate; alicyclic polyisocyanates such as dicyclohexylmethane diisocyanate and isophorone diisocyanate; and aromatic polyisocyanates such as tolylene diisocyanate, diphenylmethane diisocyanate, p-phenylene diisocyanate, naphthylene diisocyanate and xylylene diisocyanate.

Specific examples of the polyol include ethylene glycol, propylene glycol, 1,3-butylene glycol, 1,4-butylene glycol, neopentyl glycol, hydrogenated bisphenol A, hydrogenated bisphenol F, polytetramethylene glycol, polyester diols, trimethylol propane, 1,2,4-butanetriol, 1,2,6-hexanetriol, glycerol and pentaerythritol. Specific examples of the polyhydric phenol include bisphenol A and bisphenol F. Specific examples of the polyether polyol include adducts of the above polyol or polyhydric phenol with an alkyleneoxide such as ethyleneoxide and propyleneoxide.

The one-component moisture curing polyurethane resin usable in the present invention may be produced by an ordinary synthesis method in which the above polyisocyanate and polyol, etc., are compounded with each other in such an amount that a ratio of an NCO group to an OH group therein is usually in the range of from 1.5 to 5.0 and preferably from 1.7 to 3.0. The content of isocyanate groups in the one-component moisture curing polyurethane resin is usually from 0.5 to 20% by mass, preferably from 1 to 10% by mass and more preferably from 2 to 8% by mass. When the isocyanate group content is 0.5% by mass or more, the effect of enhancing a curing rate of the one-component moisture curing polyurethane resin can be sufficiently attained, so that the serum or plasma and the cell-containing component can be sufficiently separated from each other. On the other hand, when the isocyanate group content is 20% by mass or less, the curing rate of the one-component moisture curing polyurethane resin can be kept at an adequate level without becoming excessively high.

The separating material of the present invention may also contain an ordinary curing catalyst for curing the moisture curing component, if required. The content of the curing catalyst in the separating material is usually in the range of from 0.01 to 20 parts by mass on the basis of 100 parts by mass of the moisture curing component. When the content of the curing catalyst in the separating material is 0.01 part by mass or more, a sufficient curing rate of the moisture curing component can be attained, so that the serum or plasma and the cell-containing component can be sufficiently separated from each other. On the other hand, when the content of the curing catalyst in the separating material is 20 parts by mass or less, the curing rate of the moisture curing component can be kept at an adequate level without becoming excessively high.

For example, when using the reactive silicone-based compound as the moisture curing component, the separating material of the present invention may contain a curing catalyst such as organic tin compounds, metal complexes and organic phosphorus oxides, if required. Specific examples of the curing catalyst include tin compounds such as dibutyl tin dilaurate, dibutyl tin phthalate and stannous octylate; titanate compounds, e.g., titanium alkoxides such as tetrabutyl titanate and tetraisopropyl titanate, titanium chelates such as "ORGATIX TC-750" and "ORGATIX T-2970" both available from Matsumoto Fine Chemical Co., Ltd., titanium acylates, and triethanol amine titanate; organic zirconium compounds such as zirconium alkoxides, zirconium acylates and zirconium chelates; carboxylic acid metal salts such as lead octylate, lead naphthenate, nickel naphthenate and cobalt naphthenate; metal acetyl acetate complexes such as aluminum acetyl acetate complex and vanadium acetyl acetate complex; and amine salts such as dibutyl amine-2-ethyl hexoate. Among these curing catalysts, preferred are tin compounds and titanate compounds, and more preferred are titanate compounds. Further, among these titanate compounds, still more preferred are titanium chelates. However, these curing catalysts may give adverse influence on the results of blood tests depending upon some test items. Therefore, in such a case, it is preferable to use none of the curing catalysts in the separating material.

In addition, when using the titanium compound as the curing catalyst in the separating material, the moisture curing component tends to be colored yellow. In this case, the color of a resin as the moisture curing component is changed to white color or light yellow color. Therefore, by observing the change in color of the resin, it is possible to suitably recognize an extent of curing of the moisture curing component from outside of the collection tube.

The content of the curing catalyst in the separating material is preferably from 0.01 to 10 parts by mass, more preferably from 0.1 to 5 parts by mass and still more preferably from 0.2 to 3 parts by mass on the basis of 100 parts by mass of the reactive silicone-based compound in order to attain a sufficient curing rate of the moisture curing component. When the content of the curing catalyst in the separating material is 0.01 part by mass or more, a sufficient effect of enhancing a curing rate of the moisture curing component is attained. When the content of the curing catalyst in the separating material is 10 part by mass or less, an excessive increase in curing rate of the moisture curing component can be prevented, and the separating material can exhibit a sufficient storage stability.

When using the one-component moisture curing polyurethane resin as the moisture curing component, the separating material of the present invention may also contain, if required, a curing catalyst, e.g., an organic metal catalyst such as tin compounds such as dibutyl tin dilaurylate and titanium compounds, and tertiary amine compounds such as triethyl amine and triethylene diamine.

However, these curing catalysts may give adverse influence on the results of blood tests depending upon some test items. Therefore, in such a case, it is preferable to use none of the curing catalysts in the separating material. The amount of the curing catalyst compounded in the separating material is preferably from 0.01 to 10 parts by mass on the basis of 100 parts by mass of the one-component moisture curing polyurethane resin in order to attain a sufficient curing rate of the moisture curing component. When the content of the curing catalyst compounded is 0.01 part by mass or more, a sufficient effect of enhancing a curing rate of the one-component moisture curing polyurethane resin can be attained. When the content of the curing catalyst compounded is 10 parts by mass or less, an excessive increase in curing rate of the one-component moisture curing polyurethane resin can be prevented, and the separating material can exhibit a sufficient storage stability.

The separating material of the present invention may also contain, in addition to the moisture curing component such as the above moisture curing resin or compound, the other resin or compound having no reactivity by itself, and/or the other curing resin or compound of a different curing type such as those of a heat-curing type and an electron radiation curing type, if required.

In accordance with the present invention, it is essentially required that the serum or plasma separating material contains the moisture curing component having a specific gravity of from 1.03 to 1.09. When the specific gravity of the moisture curing component is out of the above-specified range, the serum or plasma separating material is not disposed between the serum or the like and the cell-containing component which results in failure to attain the aimed effects of the present invention. From the above viewpoints, the specific gravity of the moisture curing component in the separating material according to the present invention is preferably in the range of from 1.03 to 1.07 and more preferably from 1.035 to 1.055.

In order to control the specific gravity of the moisture curing component used in the serum or plasma separating material according to the present invention to the above specified range, the kind of resin or compound used as a main component of the moisture curing component as well as the kind of monomers used for forming the resin or compound, etc., may be appropriately selected. The specific gravity of the moisture curing component is preferably controlled by suitable selection of these constituents from the viewpoint of a good stability of the resulting separating material. On the other hand, there may also be used an alternative method in which the specific gravity of the moisture curing component is adjusted to the above specified range by compounding a specific gravity modifier therein. This method is advantageous in that the specific gravity is relatively easily controlled.

Specific examples of the specific gravity modifier include silica and zeolite such as "Aerosil 130", "Aerosil R972" and "Aerosil OX50" all available from Nippon Aerosil Co., Ltd.; bentonites such as "Bentone 38" and "Bentone SD-1" both available from Elementis Specialties Corp.; minerals such as smectite clay, kaolin clay and antigorite; inorganic fine particles containing calcium carbonate, titanium dioxide or the like; and polymer fine particles of polystyrenes, polyurethanes, polymethyl (meth)acrylates, acrylonitrile-styrene copolymers and rubbers. These specific gravity modifiers may also be used as a viscosity modifier. In addition, the inorganic fine particles may also be used as a thixotropy imparting agent.

When adding only the specific gravity modifier to the resin used as the moisture curing component, the viscosity of the resulting resin is preferably from 0.1 to 1000 Pa·s, preferably from 0.5 to 500 Pa·s, and more preferably from 1 to 100 Pa·s. When the viscosity of the resin is 0.1 Pa·s or more, the specific gravity modifier and the resin can be prevented from being separated from each other when subjected to centrifugal separation. On the other hand, when the viscosity of the resin is 1000 Pa·s or less, the resin has an adequate viscosity without becoming excessively high, so that the separating material can exhibit a sufficient adhesion to a wall surface of the collection tube without deterioration in bonding property therebetween when subjected to the centrifugal separation.

The hardness of the moisture curing component used in the present invention after being cured is preferably controlled such that the resulting cured product has a strength capable of withstanding breakage thereof even when contacting with a tip end of a pipette upon dispensing the respective components, or a strength capable of avoiding occurrence of breakage thereof owing to vibration upon transportation or handling. More specifically, when the separating material is used in a collection tube, the hardness of the moisture curing component after being cured is preferably controlled such that the separating material has a strength and an adhesion property to such an extent that no peeling of the separating material from an inner wall surface of the collection tube occurs.

The separating material of the present invention may also contain, if required, a reinforcing material such as beads, powders and molded articles. When the separating material contains the reinforcing material even the separating material having a low hardness can exhibit an increased strength. For example, in the case where the blood components are examined using an automatic analyzer in a clinical test, it is possible to prevent a probe of the automatic analyzer to erroneously suck the separating material thereinto. In addition, the separating material having an increased strength can show a high bonding strength to a wall surface so that the cell-containing component can be prevented from leaking through an interface between the separating material and the wall surface into the serum or plasma component.

Examples of the reinforcing material usable in the present invention include polystyrenes, polyurethanes, acrylic resins, polyolefins and silicone resins. Among these reinforcing materials, preferred are polystyrenes. Further, as the reinforcing material, there may also be used the molded articles as a cured product of the moisture curing component contained in the separating material.

The specific gravity of the reinforcing material is preferably from 1.03 to 1.09, more preferably from 1.03 to 1.07, still more preferably from 1.035 to 1.055, and especially preferably is similar to that of the separating material, in order to place the reinforcing material at the position between the cell-containing component and the serum or plasma component. The amount of the reinforcing material added to the separating material is preferably from 2 to 900 parts by mass on the basis of 100 parts by mass of the moisture curing component. When the amount of the reinforcing material added is 2 parts by mass or more on the basis of 100 parts by mass of the moisture curing component, the separating material can be enhanced in strength and ensure a good bonding property to the wall surface. When the amount of the reinforcing material added is 900 parts by mass or less, the separating material is hardly deteriorated in fluidity, has a sufficient function of separating the cell-containing component and the serum or the like from each other, and ensures a good bonding property to a tube wall surface. From the above viewpoints, the amount of the reinforcing material added to the separating material is more preferably from 5 to 250 parts by mass and still more preferably from 10 to 100 parts by mass on the basis of 100 parts by mass of the moisture curing component.

The reinforcing material may be added to the separating material either in the form of a mixture with the moisture curing component or separately from the moisture curing component. More specifically, the reinforcing material in the form of a powder is preferably mixed as a filler in the moisture curing component, followed by enclosing the resulting mixture in a capsule, a container, etc., as described below. The reinforcing material in the form of beads may be mixed in the moisture curing component, may be enclosed together with the moisture curing component in a capsule, a container, etc., or may be disposed outside of a blood isolating material such as a capsule and a container. Also, the reinforcing material in the form of a molded article may be enclosed together with the moisture curing component in a capsule, a container, etc., or may be disposed outside of a blood isolating material such as a capsule and a container (refer to FIGS. 4-1 to 4-3 and FIGS. 5-1 to 5-3). In any of the above configurations, the reinforcing material is at least partially incorporated in a cured product of the moisture curing component upon the curing to thereby enhance a strength of the resulting separating material.

In addition, the separating material of the present invention may also contain a tackifier in order to enhance a bonding property of the separating material to a wall of a test tube. As the tackifier, there may be used silane coupling agents. Examples of the silane coupling agents include aminopropyl trimethoxysilane and glycidyl triethoxysilane.

The serum or plasma separating material of the present invention initiates a curing reaction thereof by the action of water contained in blood. Therefore, before separating the serum or the like and the cell-containing component from each other by centrifugal separation, the separating material is preferably prevented from coming into contact with water. In order to prevent the contact between the separating material and blood, a blood isolating material is preferably disposed so as to prevent the moisture curing component from coming into contact with blood. For example, for this purpose, there may be used the method in which the moisture curing component is enclosed in a capsule, the method in which the moisture curing component is received in a container, the method in which a isolating wall such as a filter is disposed between the separating material and blood, etc. The blood isolating material may be made of a material capable of preventing the contact between the separating material and blood, and any material may be used without particular limitations as long as it is broken upon the centrifugal separation. Specific materials and configurations of the blood isolating material are described in detail hereinafter.

As the method of bringing the moisture curing component and blood into contact with each other by centrifugal separation, there may be mentioned the method in which the blood isolating material is disposed such that bonding between the blood isolating material and an inner wall surface of the collection tube is released by gravity owing to the centrifugal separation, or the method in which a solid having a high specific gravity (hereinafter referred to as a "high-specific gravity solid") is disposed in the vicinity of the blood isolating material (refer to FIGS. 2-1 to 2-3 and FIGS. 3-1 to 3-3). In the former method, the material of the blood isolating material may be selected from those materials which are capable of releasing a bonding force of a material which serves for bonding the blood isolating material to an inner wall surface of the collection tube (such as the blood isolating material itself, a bonding agent, an adhesive and a tackifier). In the latter method, before the centrifugal separation, the moisture curing component and blood are still prevented from coming into contact with each other by the blood isolating material so that no curing reaction of the moisture curing component proceeds, and upon the centrifugal separation, the high-specific gravity Solid serves for breaking the blood isolating material so that the moisture curing component and blood are brought into contact with each other to thereby initiate curing of the moisture curing component. The high-specific gravity solid may be disposed in various configurations. The high-specific gravity solid may be disposed above the blood isolating material as described in detail hereinafter. Also, the latter method in which the high-specific gravity solid may be disposed in the vicinity of the capsule includes such a technical concept that the high-specific gravity solid is enclosed in a capsule together with the moisture curing component.

Upon selecting materials, sizes, thicknesses, masses, etc., of the blood isolating material and the high-specific gravity solid, it should be noted that before the centrifugal separation, the moisture curing component and blood are prevented from coming into contact with each other by the blood isolating material, and after the centrifugal separation, the blood isolating material is at least partially readily broken by the high-specific gravity solid to allow the moisture curing component and blood to contact with each other. In addition, the blood isolating material and the high-specific gravity solid are respectively preferably made of a material having a higher specific gravity than that of the moisture curing component such that both the components are allowed to be present in the cell-containing component after the centrifugal separation. This is because the cell-containing component is usually excluded from objective components to be examined, and there therefore occur no significant problems even though the cell-containing component contains the blood isolating material and the high-specific gravity solid.

As the high-specific gravity solid, there may be used plastic materials, ceramic materials such as silica and alumina, and metals. The specific gravity of the high-specific gravity solid is preferably in the range of from 1.1 to 15.0, more preferably from 1.2 to 10.0 and especially preferably from 1.3 to 8.0.

The high-specific gravity solid may have various shapes including a spherical shape, a polyhedral shape, a cylindrical shape and a rectangular parallelopiped shape. Among these shapes, preferred are those shapes which are chamfered so as to hardly undergo physical breakage upon transportation, and more preferred is a spherical shape. The single high-specific gravity solid may be used, or a plurality of the high-specific gravity solids may also be used.

The size of the high-specific gravity solid is not particularly limited, and the high-specific gravity solid may have any size as long as it can be received in the collection tube. More specifically, the high-specific gravity solid preferably has a diameter smaller by 1 mm or more than a diameter of the collection tube so as not to inhibit movement of blood therein upon the centrifugal separation. The lower limit of the diameter of the high-specific gravity solid is not particularly limited and may be appropriately determined as long as the high-specific gravity solid has a sufficient weight capable of releasing the moisture curing component. The diameter of the high-specific gravity solid is usually 0.5 mm or more since such a high-specific gravity solid suitably has a sufficient weight capable of discharging the moisture curing component.

Meanwhile, the specific embodiments using the high-specific gravity solid are described in detail below by referring to FIGS. 2-1 to 2-3 and FIGS. 3-1 to 3-3.

The material of the capsule serving for enclosing the moisture curing component may be the same as or different from the cured product of the moisture curing component. In addition, the material of the capsule may be either an elastic material or a non-elastic material. Specific examples of the material of the capsule include films made of polyolefins such as polyethylene and polypropylene; polyesters such as polyethylene terephthalate; fluororesins such as polytetrafluoroethylene; polysaccharides such as pullulan, carageenan, collagen, gelatin and starches; water-soluble polymers such as proteins, polyvinyl alcohol and polyethylene glycol; and metals such as aluminum. Further, the capsule may be constructed from a single kind of material or a plural kinds of materials.

The thickness of the capsule is preferably determined such that the moisture curing component is suitably enclosed therein and the capsule is suitably broken upon the centrifugal separation. More specifically, the thickness of the capsule is preferably in the range of from about 1 to about 1000 μm and more preferably from 5 to 500 μm.

Next, the method of receiving the moisture curing component in a container is described. In the method, the moisture curing component used in the present invention is received in a container which is lidded with a membrane having such a strength as to be broken by the centrifugal separation, etc. The lidded container is filled, for example, with the moisture curing component and the high-specific gravity solid, and the membrane, etc., as a lid is broken by a gravity of the high-specific gravity solid upon the centrifugal separation.

Figure 2:
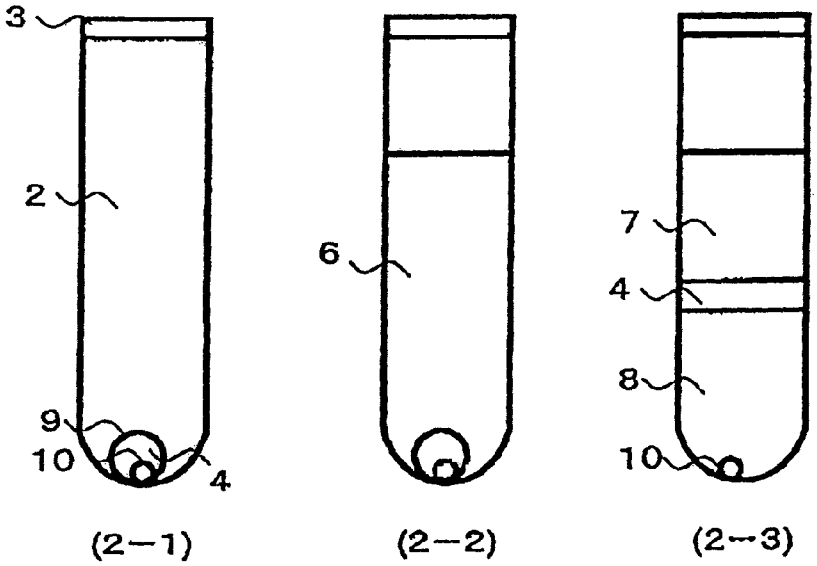
Figure 3:
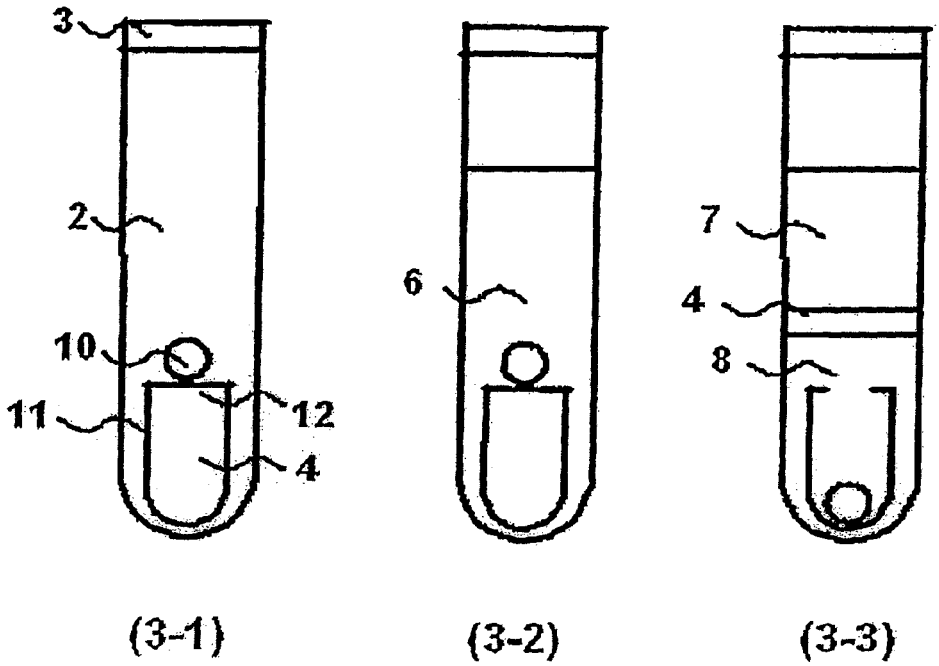

Next, the method of preventing the separating material and blood from coming into contact with each other using the blood isolating material is explained by referring to FIGS. 1-1 to 1-3.

FIGS. 1-1 to 1-3 are schematic views showing a process in which the serum or the like and the cell-containing component are separated from each other using a collection tube. FIG. 1-1 shows the collection tube 1 in which the moisture curing component 4 is disposed at a bottom of the collection tube. The blood isolating material 5 is disposed on a surface of the moisture curing material in order to prevent the moisture curing material from contacting with blood. FIG. 1-2 shows the condition immediately after whole blood 6 is collected in the collection tube 1. In this condition, the moisture curing component and the blood are prevented from contacting with each other by the blood isolating material 5 and therefore no curing of the moisture curing component is initiated. When being subjected to centrifugal separation, the blood isolating material 5 is displaced or broken to allow the moisture curing component and the blood to contact with each other, so that curing of the moisture curing component is initiated.

More specifically, upon the centrifugal separation, the moisture curing component and the cell-containing component is replaced in position with each other to thereby bring the moisture curing component into contact with the blood, so that curing of the moisture curing component is initiated. At the same time, as shown in FIG. 1-3, the blood is separated into serum or plasma 7 and the cell-containing component 8. After or while the moisture curing component is moved to the position between the serum or the like 7 and the cell-containing component 8, the moisture curing component is cured, so that the upper and lower blood components are prevented from being mixed with each other.

The blood isolating material may be either a liquid material or a solid material. In view of a stability upon transportation and an isolating property upon collecting the blood, the blood isolating material is preferably in the form of a film. Examples of the material of the liquid blood isolating material include mineral oils, vegetable oils and silicone oils. The material of the solid blood isolating material may be the same as or different from the cured product of the moisture curing component, and may also be either an elastic material or a non-elastic material. Specific examples of the suitable material of the solid blood isolating material include those materials formed of the above high-specific gravity solids, and films or gels formed of polyolefins such as polyethylene and polypropylene; polystyrenes; acrylates such as polymethyl methacrylate; polyesters such as polyethylene terephthalate; polyethers such as polyethylene glycol; fluororesins such as polytetrafluoroethylene; silicone resins such as poly(dimethyl siloxane); polysaccharides such as pullulan, carageenan, collagen, gelatin and starches; water-soluble polymers such as proteins and polyvinyl alcohol; and metals such as aluminum.

In addition, the blood isolating material may be constituted from a single material or a plurality of materials. The blood isolating material in the form of a membrane preferably has a thickness of from 1 to 10000 μm and more preferably from 5 to 500 μm.

Meanwhile, in order to displace the blood isolating material 5 to allow the moisture curing component and the blood to contact with each other, the blood isolating material 5 is prepared, for example, from a high-specific gravity solid so as to be movable by a gravity of the high-specific gravity solid upon the centrifugal separation. Alternatively, the high-specific gravity solid is disposed above the blood isolating material 5 so that the blood isolating material is moved or broken by the gravity of the high-specific gravity solid upon the centrifugal separation, thereby allowing the separating material and the blood to contact with each other.

The serum or plasma separating material of the present invention is preferably used in such a manner that the separating material is previously disposed in the collection tube, from the viewpoint of easiness of handling. The collection tube usable in the present invention is not particularly limited, and conventionally known collection tubes may be used as such. The material of the collection tube may also be the same material as used conventionally. Examples of the material of the collection tube include glass, and plastic materials such as polyesters, polyethylene, polypropylene and polymethyl methacrylate. Examples of commercially available products of the collection tube include "VENOJECT (registered trademark) II" available from Terumo Corp., etc.

The inner wall surface of the collection tube may be subjected to surface treatments to facilitate bonding of the moisture curing component thereto upon curing thereof. For example, the inner wall surface of the collection tube may be subjected to an acid or alkali treatment, a silane coupling treatment, a light irradiation treatment, an ozone treatment or the like. These surface treatments enables introduction of a functional group to the inner wall surface of the collection tube to thereby obtain the effect of facilitating the reaction between the inner wall surface and the moisture curing component.

Also, the collection tube may be charged with additives such as blood coagulation accelerators for promoting coagulation of blood, and blood anti-coagulation agents for suppressing coagulation of blood according to kinds of blood inspection or examination items. Examples of the blood coagulation accelerators include protamine sulfate, thrombin, silica sand, crystalline silica powder, diatomaceous earth, glass powder, kaolin and bentonite. Examples of the blood anti-coagulation agents include heparin and EDTA (ethylenediaminetetraacetic acid).

Meanwhile, when it is intended to obtain a serum as a supernatant by the centrifugal separation after collecting blood in the collection tube, the above coagulation accelerator may be added to the blood, whereas when it is intended to obtain a plasma, the above anti-coagulation agent may be added to the blood.

The amount of the respective additives added may vary depending upon the kinds of additives used, and is usually in the range of from 0.3 to 10.0 mg per 10 mL of the blood collected in the collection tube. When the amount of the additive added is 0.3 mg or larger, the respective additives can suitably exhibit effects thereof. When the amount of the additive added is 10.0 mg or smaller, there occur no significant problems concerning hemolysis.

The serum or plasma collection tube according to the present invention is configured such that blood is collected in the collection tube in which the serum or plasma separating material of the present invention is previously disposed, and then the contents of the collection tube are subjected to centrifugal separation. The centrifugal separation method may be the same as used conventionally. For example, the centrifugal separation procedure is carried out for about 10 min while applying a centrifugal force of about 1200 G to the contents of the collection tube to thereby separate the serum or plasma and the cell-containing component from each other.

More specifically, the moisture curing component contained in the serum or plasma separating material of the present invention has a specific gravity which is intermediate between those of the serum or the like and the cell-containing component. Therefore, the moisture curing component is disposed at an intermediate position between the serum or the like and the cell-containing component in an uncured state as such or while allowing a curing reaction thereof to proceed under such a condition that the serum or the like and the cell-containing component are kept separated from each other in the collection tube. Then, the moisture curing component is subjected to curing by the action of water contained in the blood. The moisture curing component used in the present invention may be cured at the intermediate position between the serum or the like and the cell-containing component to such an extent that no breakage of the cured surface of the moisture curing component occurs owing to vibration and lay-down upon handling or contact with a pipette after completion of the centrifugal separation. The curing time of the moisture curing component may be optionally determined. However, it is desirable the curing of the moisture curing component is completed upon termination of the centrifugal separation.

By using the serum or plasma separating material according to the present invention, it is possible to separate the serum or the like and the cell-containing component from each other merely by the centrifugal separation and prevent these separated components from being mixed again with each other. Therefore, even when the blood specimen is transported after separation of the respective blood components from a hospital to a blood inspection or examination center, etc., the serum or the like and the cell-containing component can be inhibited from being mixing again with each other.

The collection tube of the present invention preferably has the following construction. That is, as described above, in the collection tube, the moisture curing component contained in the separating material is kept isolated from water so as not to cause curing thereof by contact with water when blood is collected therein, and the moisture curing component and the blood are brought into contact with each other at the subsequent centrifugal separation stage. In particular, the serum or plasma separating material of the present invention which is disposed in the collection tube preferably includes, in addition to the moisture curing component, the above blood isolating material.

More specifically, as described above, there is preferably used such a method in which the moisture curing component which is enclosed in a capsule or a lidded container is brought into contact with water when the capsule, etc., is broken by the centrifugal separation.

Next, by referring to FIGS. 2-1 to 2-3 and FIGS. 3-1 to 3-3, the embodiment in which the blood isolating material is at least partially broken by the above high-specific gravity solid such that the moisture curing component and blood are brought into contact with each other to initiate curing of the moisture curing component, is explained.

FIGS. 2-1 to 2-3 show the method in which the moisture curing component 4 is enclosed in a capsule 9 as the blood isolating material, and a high-specific gravity solid 10 is also enclosed in the capsule (refer to FIG. 2-1). In this method, as shown in FIG. 2-2, even when collecting whole blood 6 in the collection tube, the moisture curing component is free from contact with water, and therefore curing of the moisture curing component is not initiated. When being subjected to centrifugal separation under this condition, the capsule 9 is holed by the high-specific gravity solid 10 owing to a centrifugal force thereof upon the centrifugal separation, so that the moisture curing component 4 enclosed in the capsule is discharged through the resulting opening from the capsule.

In the embodiment shown in FIGS. 3-1 to 3-3, the moisture curing component 4 is received in a container 11, and then the container 11 is closed by a film-like lid 12 as the blood isolating material, and further the high-specific gravity solid 10 is disposed outside of the container 11 (refer to FIG. 3-1). In this method, as shown in FIG. 3-2, even when whole blood 6 is collected in the collection tube, the moisture curing component is prevented from contacting with water, so that curing of the moisture curing component is not initiated. Thereafter, the film-like lid is broken by the high-specific gravity solid 10 when subjected to centrifugal separation, so that the moisture curing component can be discharged out of the container 11. At this time, in order to facilitate breakage of the film-like lid by the high-specific gravity solid 10, the high-specific gravity solid may be bonded to an upper surface of the film-like lid (FIG. 3-2). The film-like lid 12 is broken upon the centrifugal separation to allow the moisture curing component to come into contact with the blood, so that curing of the moisture curing component is initiated. As shown in FIG. 3-3, after completion of the centrifugal separation, the serum or the like 7 and the cell-containing component 8 are separated from each other, and curing of the moisture curing component 4 is initiated after or while being disposed therebetween, so that the upper and lower blood components can be prevented from being mixed again with each other.

The container 11 used above serves as the blood isolating material constituted from a molded article or a film, and the lid 12 may be constituted from a film, etc. The container may be provided with one or more openings. When using the container having one opening, a plastic molded container such as, for example, a press-through-package (PTP) may be used as the blood isolating material, and is filled with the moisture curing component, and then closed with a lid as the blood isolating material such as an aluminum vapor deposited film and an aluminum foil. When using the container having two openings, a film is attached to a lower portion of a tubular container, and after filling the moisture curing component therein, an upper portion of the container is closed with a lid. In such a case, since the container is holed at its upper and lower portions by the high-specific gravity solid, the moisture curing component can be more readily discharged out of the capsule.

The film used as the lid 12 is preferably made of a material capable of fully enclosing the moisture curing component 4 therein in an ordinary condition and capable of being readily broken by the high-specific gravity solid 10 when subjected to the centrifugal separation. More specifically, the film as the lid preferably has a burst strength of from 1 to 10000 kPa (as measured according to JIS P8112) and a breaking elongation of from 1 to 40%. The film having a burst strength of 1 kPa or more is free from brittleness and can exhibit a sufficient sealing property. On the other hand, the film having a burst strength of 10000 kPa or less can be suitably broken by the high-specific gravity solid 10 when subjected to the centrifugal separation. From the above viewpoints, the burst strength of the film as the lid 12 is more preferably from 5 to 1000 kPa and especially preferably from 10 to 500 kPa in order to further enhance the sealing property and ensure breakage thereof.

In addition, the film having a breaking elongation of 1% or more (as measured according to JIS P8113) is free from brittleness and can exhibit a sufficient sealing property. On the other hand, the film having a breaking elongation of 40% or less can be suitably broken by the high-specific gravity solid 10 when subjected to the centrifugal separation. From the above viewpoints, the breaking elongation of the film as the lid 12 is more preferably from 5 to 35% and especially preferably from 10 to 30% in order to further enhance the sealing property and ensure breakage thereof.

The film may be formed from a single polymer or a plurality of polymers and additives such as a filler, and the above burst strength and breaking elongation of the film may be suitably controlled by using adequate combination of these components or suitably adjusting contents thereof, etc.

Figure 4:
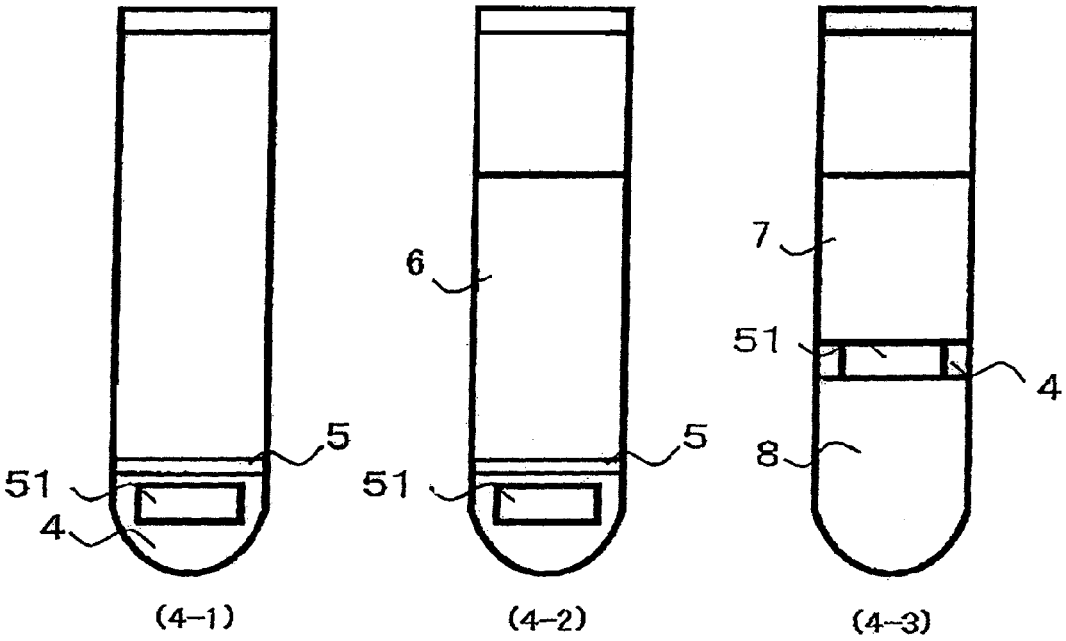
Figure 5:
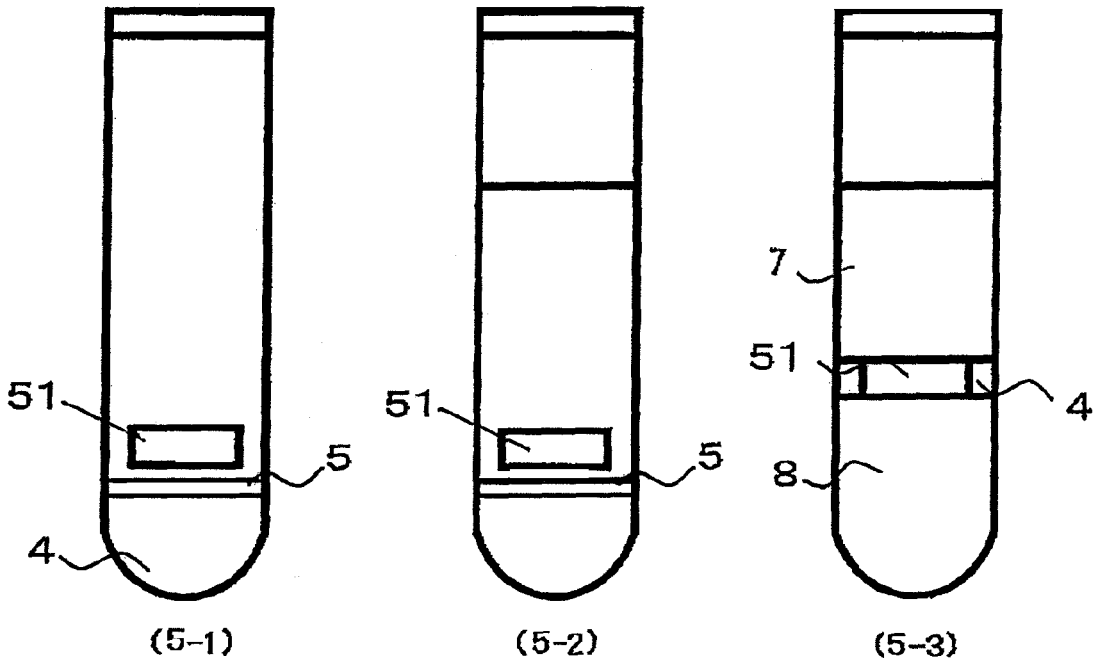

Next, the embodiment in which a molded article is used as the reinforcing material is explained by referring to FIGS. 4-1 to 4-3 and FIGS. 5-1 to 5-3. As shown in FIG. 4-1, the moisture curing component 4 and the molded article 51 are disposed in the collection tube. Even when blood is collected in the collection tube, curing of the moisture curing component does not occur since the blood isolating material 5 is disposed above the moisture curing component (FIG. 4-2). When being subjected to centrifugal separation, the blood isolating material 5 is broken or moved by the molding article 51 to allow the moisture curing component 4 and the blood to come into contact with each other, so that curing of the moisture curing component is initiated. As shown in FIGS. 4-1 to 4-3, the molded article 51 may be disposed together with the moisture curing component 4 inside of the blood isolating material 5. Alternatively, as shown in FIGS. 5-1 to 5-3, the molded article 51 may be disposed outside of the blood isolating material 5, for example, above the blood isolating material 5. In the present invention, either a single molded article or a plurality of molded articles may be used. In addition, the molded article may have various shapes such as a cylindrical shape, a disk shape, a spherical shape and a rectangular parallelopiped shape, and preferably has such a shape as is disposable along an inner wall surface of the collection tube although not particularly limited thereto. The material of the molded article may be the same as or different from the cured product of the moisture curing component. In addition, as the material of the molded article, there may also be used the same material as the solid blood isolating material. Further, the high-specific gravity solid, etc., may be disposed to allow breakage or movement of the blood isolating material.

EXAMPLES

The present invention will be described in more detail by referring to the following Examples. However, it should be noted that these examples are only illustrative and not intended to limit the invention thereto.

Example 1

A stored horse blood (available from Kohjin Bio Co., Ltd.; a mixture containing a horse blood and an Alsever's solution at a mixing ratio of 1:1) was prepared, and a moisture curing silicone resin "TSE397" (one-component condensed type (dealcoholation type) silicone resin; specific gravity: 1.04; viscosity: 50 Pa·s) available from Momentive Performance Materials Japan Inc., was used as a moisture curing component.

A collection tube (vacuum blood collection tube filled with a curing accelerator; available from Terumo Corp.) was opened with a lid being off, and charged with 1 mL of the moisture curing silicone resin. Then, 8 mL of the stored horse blood is charged into the collection tube, and the open end of the collection tube was closed with a lid for recapping ("Venoject II Recap" available from Terumo Corp.), and then the thus filled collection tube was subjected to centrifugal separation. The centrifugal separation was carried out at 3000 rpm (1200 G) for 10 min. As a result, it was confirmed that although plasma was sufficiently separated from the blood, slight hemolysis was observed.

Further, the plasma component was removed from the collection tube by decantation, and then a cured product of the moisture curing component was pushed with a wood bar having a length of 10 cm and a diameter of 2 mm. As a result, it was confirmed that the moisture curing component was cured sufficiently.

Example 2

The same separating procedure as in Example 1 was repeated except for using a silicone resin "TSE392" (one-component condensed type (dealcoholation type) silicone resin; specific gravity: 1.04) available from Momentive Performance Materials Japan Inc., as the moisture curing silicone resin. As a result, it was confirmed that although plasma was sufficiently separated from the blood, slight hemolysis was observed.

Further, the plasma component was removed from the collection tube by decantation, and then a cured product of the moisture curing component was pushed with a wood bar having a length of 10 cm and a diameter of 2 mm. As a result, it was confirmed that the moisture curing component was cured sufficiently.

Example 3

The same separating procedure as in Example 1 was repeated except for using a silicone resin "TSE389" (one-component condensed type (deoximation type) silicone resin; specific gravity: 1.04; viscosity: 5.6 Pa·s) available from Momentive Performance Materials Japan Inc., as the moisture curing silicone resin. As a result, it was confirmed that although plasma was sufficiently separated from the blood, slight hemolysis was observed.

Further, the plasma component was removed from the thus treated blood by decantation, and then a cured product of the moisture curing component was pushed with a wood bar having a length of 10 cm and a diameter of 2 mm. As a result, it was confirmed that the moisture curing component was cured sufficiently.

Comparative Example 1

The same separating procedure as in Example 1 was repeated except for using a vacuum blood collection tube filled with a serum separating material (available from Terumo Corp.) but using no moisture curing silicone resin. As a result, it was confirmed that plasma was separated from the blood. After the plasma component was removed from the collection tube by decantation, a wood bar having a length of 10 cm and a diameter of 2 mm was placed on the remaining contents in the collection tube. As a result, the wood bar was suck down by its gravity in the cell-containing component. cl Example 4

A stored horse blood (available from Kohjin Bio Co., Ltd.; a mixture containing a horse blood and an Alsever's solution at a mixing ratio of 1:1) was prepared. Further, 2 mL of a moisture curing silicone resin "TSE397" (one-component condensed type (dealcoholation type) silicone resin; specific gravity: 1.04; viscosity: 50 Pa·s) available from Momentive Performance Materials Japan Inc., as a moisture curing component were enclosed in a capsule formed by closing each of upper and lower open ends of a low-density polyethylene tube (LDPE tube; outer diameter: 11 mm; thickness: 0.4 mm; length: 20 mm) by a Parafilm as a lid ("PM-992" available from Pechiney Plastic Packaging, Inc.).

A collection tube (vacuum blood collection tube filled with a curing accelerator; available from Terumo Corp.) was opened with a lid being off, and the capsule enclosing the moisture curing silicone resin was placed in the collection tube. On the capsule was disposed a high-specific gravity solid (shape: spherical shape; diameter: 6 mm; material: glass; specific gravity: 2.5). Then, 8 mL of the stored horse blood were charged into the collection tube, and the open end of the collection tube was closed with a lid for recapping ("Venoject II Recap" available from Terumo Corp.), and the thus filled collection tube was allowed to stand for 3 h and then subjected to centrifugal separation to separate the blood into plasma and a cell-containing component. The centrifugal separation was carried out at 3000 rpm (1200 G) for 10 min. Thereafter, the thus separated blood components were allowed to stand for 3 h, and the plasma component was separated therefrom by decantation. Then, a cured product of the moisture curing component was pushed with a wood bar having a length of 10 cm and a diameter of 2 mm. As a result, it was confirmed that the moisture curing component was cured sufficiently. Although the plasma component was separated from the blood, slight hemolysis was observed.

Example 5

A stored horse blood (available from Kohjin Bio Co., Ltd.) was prepared, and 93.75% by mass of a modified silicone ("SAX220" available from Kaneka Corp.; viscosity: 46 Pa·s) as a moisture curing component were mixed with 6.25% by mass of calcium carbonate (available from Wako Pure Chemical Industries, Ltd.) as a specific gravity modifier to adjust a specific gravity of the resulting mixture to 1.05. Then, 1 part by mass of a titanium-based curing catalyst ("TC-750" available from Matsumoto Fine Chemical Co., Ltd.) was added to 100 parts by mass of the above mixture (moisture curing component) to prepare a separating material.

A collection tube (vacuum blood collection tube filled with a curing accelerator; available from Terumo Corp.) was opened with a lid being off, and 1.7 mL of the separating material were placed in the collection tube. Then, 8 mL of the stored horse blood were charged into the collection tube, and the open end of the collection tube was closed with a lid for recapping ("Venoject II Recap" available from Terumo Corp.), and the thus filled collection tube was subjected to centrifugal separation. The centrifugal separation was carried out at 3000 rpm (1200 G) for 10 min. As a result, it was confirmed that a plasma component was sufficiently separated from the blood, and any cell-containing component was not included in the plasma component. Then, the collection tube was preserved in a refrigerator (maintained at 4° C.) for 2 days.

The plasma component separated by the centrifugal separation was measured for biochemical inspection items thereof immediately after the centrifugal separation and after the elapse of 2 days (after preserved in the refrigerator) using an automatic biochemical analyzer ("Hitachi Clinical Analyzer S40" available from Hitachi Chemical Co., Ltd.). The results are shown in Table 1. The results of the biochemical inspection items were substantially the same as those of the case where the plasma component was separated by decantation (see the below-mentioned Reference Example 1) in which the blood component showed a less change even after stored for a long period of time.

Meanwhile, the biochemical inspection items as measured above include ALP, AST, CK, LD, LDL and HDL.

Reference Example 1

A collection tube filled with a serum separating material (available from Terumo Corp.) was charged with 8 mL of the same stored horse blood as used in Example 5, and subjected to centrifugal separation in the same manner as in Example 5. Then, the plasma component was removed from the collection tube by decantation, and transferred into another test tube. The test tube filled with the plasma component was preserved in a refrigerator (maintained at 4° C.) for 2 days. The plasma component was then measured for biochemical inspection items thereof immediately after the centrifugal separation and after the elapse of 2 days (after preserved in the refrigerator) in the same manner as in Example 5. The results are shown in Table 1.

Comparative Example 2

A collection tube (vacuum blood collection tube filled with a serum separating material; available from Terumo Corp.) was opened with a lid being off, and 8 mL of a stored horse blood were charged into the collection tube. Then, the open end of the collection tube was closed with a lid for recapping ("Venoject II Recap" available from Terumo Corp.), and the thus filled collection tube was subjected to centrifugal separation. The centrifugal separation was carried out at 3000 rpm (1200 G) for 10 min. As a result, it was confirmed that a plasma component was sufficiently separated from the blood, and any cell-containing component was not included in the plasma component. Then, the collection tube was preserved in a refrigerator (maintained at 4° C.) for 2 days.

The plasma component was measured for biochemical inspection items thereof immediately after the centrifugal separation and after the elapse of 2 days (after preserved in the refrigerator). The results are shown in Table 1. When the measurement results obtained after the elapse of 2 days were compared with those of Reference Example 1 (decantation), it was confirmed that the values of ALP, AST and LD were increased.

TABLE 1

| Measuring items | Example 5 | | Reference Example 1 (decantation) | | Comparative Example 2 | |
|---|---|---|---|---|---|---|
| | Immediately after separation | After the elapse of 2 days | Immediately after separation | After the elapse of 2 days | Immediately after separation | After the elapse of 2 days |
| ALP | 233 | 258 | 237 | 251 | 236 | 324 |
| AST | 112 | 120 | 113 | 113 | 112 | 125 |
| CK | 91 | 90 | 89 | 85 | 94 | 91 |
| LD | 218 | 278 | 222 | 218 | 219 | 335 |
| LDL | 5.9 | 4.1 | 6.1 | 4.2 | 4.9 | 4.5 |
| HDL | 21 | 21 | 22 | 20 | 20 | 21 |

Example 6

A stored horse blood (available from Kohjin Bio Co., Ltd.; different lot from that used in Example 5) was prepared.

A collection tube (vacuum blood collection tube filled with a curing accelerator; available from Terumo Corp.) was opened with a lid being off, and 1.7 mL of the same separating material as preserved in Example 5 were placed in the collection tube. Then, 8 mL of the stored horse blood were charged into the collection tube, and the open end of the collection tube was closed with a lid for recapping ("Venoject II Recap" available from Terumo Corp.), and the thus filled collection tube was subjected to centrifugal separation under the same conditions as used in Example 5. As a result, it was confirmed that a plasma component was sufficiently separated from the blood, and any cell-containing component was not included in the plasma component. Then, the contents of the collection tube were preserved in a frozen state in a freezer (maintained at −20° C.). After 2 days, the collection tube was returned to a room temperature condition. As a result, it was confirmed that no leakage of the cell-containing component into the plasma component was observed.

The plasma component was measured for biochemical inspection items thereof immediately after the centrifugal separation and when returned to the room temperature condition after the 2 day-preservation in the freezer in the same manner as used in Example 5. The results are shown in Table 2. As a result, it was confirmed that by using the method according to the present invention, even after being preserved in a frozen state for 2 days, the blood component showed a less change owing to the long-term storage as compared to that separated by decantation (see the below-mentioned Reference Example 2).

Reference Example 2

A collection tube filled with a serum separating material (available from Terumo Corp.) was charged with 8 mL of the same stored horse blood as used in Example 6, and subjected to centrifugal separation in the same manner as in Example 6. The plasma component was separated from the thus treated blood by decantation, and transferred into another test tube. The contents of the test tube were preserved in a frozen state in a freezer (maintained at −20° C.). The plasma component was measured for biochemical inspection items thereof immediately after the centrifugal separation and after preserved in a frozen state for 2 days in the same manner as used in Example 6. The results are shown in Table 2.

Comparative Example 3

A collection tube (vacuum blood collection tube filled with a serum separating material; available from Terumo Corp.) was opened with a lid being off, and 8 mL of a stored horse blood were charged into the collection tube. The open end of the collection tube was closed with a lid for recapping ("Venoject II Recap" available from Terumo Corp.), and the thus filled collection tube was subjected to centrifugal separation. The centrifugal separation was carried out at 3000 rpm (1200 G) for 10 min. As a result, it was confirmed that a plasma component was sufficiently separated from the blood, and any cell-containing component was not included in the plasma component. Then, the contents of the collection tube were preserved in a frozen state in a freezer (maintained at −20° C.) for 2 days, and then the collection tube was returned to a room temperature condition. As a result, it was confirmed that leakage of the cell-containing component into the plasma component on the upper portion of the separating material was visually observed.

The plasma component was measured for biochemical inspection items thereof immediately after the centrifugal separation and after preserved for 2 days (after preserved in the freezer) in the same manner as used in Example 6. The results are shown in Table 2. When the measurement results obtained after the 2 day preservation were compared with those of Reference Example 2 (decantation), it was confirmed that the values of ALP, CK and LD were considerably changed.

TABLE 2

| Measuring items | Example 6 | | Reference Example 2 (decantation) | | Comparative Example 3 | |
|---|---|---|---|---|---|---|
| | Immediately after separation | After freezing and thawing | Immediately after separation | After freezing and thawing | Immediately after separation | After freezing and thawing |
| ALP | 287 | 305 | 287 | 285 | 273 | 369 |
| AST | 108 | 112 | 108 | 109 | 110 | 120 |
| CK | 105 | 138 | 107 | 112 | 102 | 161 |
| LD | 348 | 388 | 337 | 346 | 344 | 433 |
| LDL | 6.7 | 4.8 | 7.1 | 6.7 | 4.5 | 6.6 |
| HDL | 18 | 17 | 18 | 19 | 18 | 18 |

Example 7

A stored horse blood (available from Kohjin Bio Co., Ltd.) was prepared, and 94% by mass of a modified silicone ("SAT400" available from Kaneka Corp.; viscosity: 24 Pa·s) as a moisture curing component were mixed with 6.0% by mass of calcium carbonate (available from Wako Pure Chemical Industries, Ltd.) as a specific gravity modifier to adjust a specific gravity of the resulting mixture to 1.05. Then, 0.5 part by mass of a titanium-based curing catalyst ("TC-750" available from Matsumoto Fine Chemical Co., Ltd.) was added to 100 parts by mass of the above mixture (moisture curing component) to prepare a separating material. Then, a polypropylene container (a round bottom tube having a diameter of 1 cm and a length of 2 cm) was filled with 1.5 mL of the separating material, and an aluminum film (available from Nippon Foil Manufacturing Co., Ltd.; thickness: 0.02 mm) as a blood isolating material was heat-bonded to an open end of the container to close the container with the lid, thereby obtaining a capsule.

A collection tube (vacuum blood collection tube filled with a curing accelerator; available from Terumo Corp.) was opened with a lid being off, and the capsule was placed in the collection tube, and then glass beads (diameter: 6 mm; specific gravity: 2.5) as a high-specific gravity solid were disposed on the capsule. Then, 8 mL of the stored horse blood were charged into the collection tube, and the open end of the collection tube was closed with a lid for recapping ("Venoject II Recap" available from Terumo Corp.), and the thus filled collection tube was subjected to centrifugal separation. The centrifugal separation was carried out at 3000 rpm (1200 G) for 10 min. The capsule was broken upon the centrifugal separation, so that the moisture curing component filled therein was discharged outside from the capsule and disposed between the plasma component and the cell-containing component. As a result, it was confirmed that the plasma component was sufficiently separated from the blood, and any cell-containing component was not included in the plasma component.

Example 8

The same separating procedure as in Example 7 was repeated except that the following components were filled in the polypropylene container, and the thus filled container was closed with a lid for recapping and, after the elapse of 1 day, subjected to centrifugal separation.

That is, 86.35% by mass of a modified silicone ("ST280" available from Kaneka Corp.; viscosity: 7 Pa·s) as a moisture curing component were mixed with 13.65% by mass of "Bentone 38" (available from Elementis Specialties Inc.) as a specific gravity modifier to adjust a specific gravity of the resulting mixture to 1.05. Then, 0.5 part by mass of a titanium-based curing catalyst ("TC-750" available from Matsumoto Fine Chemical Co., Ltd.) was added to 100 parts by mass of the above mixture (moisture curing component) to prepare a component to be filled in the above polypropylene container.

The capsule was broken upon the centrifugal separation, so that the moisture curing component filled therein was discharged outside from the capsule and disposed between the plasma component and the cell-containing component. As a result, it was confirmed that the plasma component was sufficiently separated from the blood, and any cell-containing component was not included in the plasma component.

Example 9

The same separating procedure as in Example 7 was repeated except that the following components were filled in the polypropylene container, and the thus filled container was closed with a lid for recapping and, after the elapse of 1 day, subjected to centrifugal separation.

That is, 91% by mass of a modified silicone ("SAT400" available from Kaneka Corp.; viscosity: 24 Pa·s) as a moisture curing component were mixed with 9% by mass of silica particles ("OX50" available from Nippon Aerosil Co., Ltd.; particle size: 40 nm) as a specific gravity modifier to adjust a specific gravity of the resulting mixture to 1.05. Then, 0.5 part by mass of a titanium-based curing catalyst ("TC-750" available from Matsumoto Fine Chemical Co., Ltd.) was added to 100 parts by mass of the above mixture (moisture curing component) to prepare a component to be filled in the above polypropylene container.

The capsule was broken upon the centrifugal separation, so that the moisture curing component filled therein was discharged outside from the capsule and disposed between the plasma component and the cell-containing component. As a result, it was confirmed that the plasma component was sufficiently separated from the blood, and any cell-containing component was not included in the plasma component.

Example 10

The same separating procedure as in Example 9 was repeated except that the following components were filled in the polypropylene container.

That is, 91% by mass of a modified silicone ("SAT400" available from Kaneka Corp.; viscosity: 24 Pa·s) as a moisture curing component were mixed with 9% by mass of silica particles ("OX50" available from Nippon Aerosil Co., Ltd.; particle size: 40 nm) as a specific gravity modifier to adjust a specific gravity of the resulting mixture to 1.05. Then, 0.5 part by mass of a titanium-based curing catalyst ("TC-750" available from Matsumoto Fine Chemical Co., Ltd.) and 30 parts by mass of polystyrene beads (a spherical shape having a diameter of 0.3 mm; available from Hitachi Chemical Co., Ltd.) as a reinforcing material were added to 100 parts by mass of the above mixture (moisture curing component) to prepare a component to be filled in the above polypropylene container.

The capsule was broken upon the centrifugal separation, so that the moisture curing component filled therein was discharged outside from the capsule and disposed between the plasma component and the cell-containing component. As a result, it was confirmed that the plasma component was sufficiently separated from the blood, and any cell-containing component was not included in the plasma component.

Example 11

A stored horse blood (available from Kohjin Bio Co., Ltd.) was prepared. A silicone resin "TSE397" (one-component condensed type (dealcoholation type) silicone resin; specific gravity: 1.04; viscosity: 50 Pa·s) available from Momentive Performance Materials Japan Inc., was used as a moisture curing component. In addition, the moisture curing silicone resin "TSE397" (one-component condensed type (dealcoholation type) silicone resin; specific gravity: 1.04; viscosity: 50 Pa·s) available from Momentive Performance Materials Japan Inc., as a reinforcing material was cured to form a cylindrical molded article (diameter: 11 mm; height: 6 mm; weight: 0.6 g).

A collection tube (vacuum blood collection tube filled with a curing accelerator; available from Terumo Corp.) was opened with a lid being off, and then the thus formed molded article as the reinforcing material was placed and disposed within the collection tube. Further, the collection tube was charged with 1 mL of the above moisture curing component and then with 8 mL of the stored horse blood, and the open end of the collection tube was closed with a lid for recapping ("Venoject II Recap" available from Terumo Corp.). Then, the thus filled collection tube was subjected to centrifugal separation. The centrifugal separation was carried out at 3000 rpm (1200 G) for 10 min. As a result, it was confirmed that although the plasma component was sufficiently separated from the blood, very slight hemolysis was observed.

Example 12

A stored horse blood (available from Kohjin Bio Co., Ltd.) was prepared, and 93.75% by mass of a modified silicone ("SAX220" available from Kaneka Corp.; viscosity: 46 Pa·s) as a moisture curing component were mixed with 6.25% by mass of calcium carbonate (available from Wako Pure Chemical Industries, Ltd.) as a specific gravity modifier to adjust a specific gravity of the resulting mixture to 1.05. Then, 1 part by mass of a titanium-based curing catalyst ("TC-750" available from Matsumoto Fine Chemical Co., Ltd.) was added to 100 parts by mass of the above mixture (moisture curing component), and further a polystyrene cylindrical molded article (diameter: 9 mm; height: 6 mm; specific gravity: 1.05; weight: 0.4 g) as a reinforcing material was added to the resulting mixture to thereby prepare a separating material.

A collection tube (vacuum blood collection tube filled with a curing accelerator; available from Terumo Corp.) was opened with a lid being off, and the polystyrene cylindrical molded article was placed in the collection tube. In addition, the collection tube was charged with 1.3 mL of the above mixture containing the moisture curing component and the curing catalyst. Then, 8 mL of the stored horse blood were further charged into the collection tube, and the open end of the collection tube was closed with a lid for recapping ("Venoject II Recap" available from Terumo Corp.), followed by subjecting the thus filled collection tube to centrifugal separation. The centrifugal separation was carried out at 3000 rpm (1200 G) for 10 min. As a result, it was confirmed that the plasma component was sufficiently separated from the blood, and any cell-containing component was not included in the plasma component.

Example 13

The procedure was carried out in the same manner as in Example 12 using the same blood, moisture curing component, curing catalyst and reinforcing material as those used in Example 12 except that the separation procedure was changed as follows. That is, the same procedure as in Example 12 was repeated except that a collection tube (vacuum blood collection tube filled with a curing accelerator; available from Terumo Corp.) was opened with a lid being off, and 1.3 mL of the mixture containing the moisture curing component and the curing catalyst were charged into the collection tube, and then the polystyrene cylindrical molded article (diameter: 9 mm; height: 6 mm; specific gravity: 1.05; weight: 0.4 g) as a reinforcing material was disposed on the mixture. As a result, it was confirmed that the plasma component was sufficiently separated from the blood, and any cell-containing component was not included in the plasma component.

Industrial Applicability

In accordance with the present invention, there is provided a serum or plasma separating material which can be easily handled, is capable of keeping serum or plasma and a cell-containing component in a separated state with a good storage stability for a long period of time in a collection tube, and is excellent in stability upon freezing or thawing as well as upon handling of a sample. That is, the serum or plasma and the cell-containing component are prevented from being mixed with each other even after the elapse of time, so that a blood test can be carried out with a high accuracy.

In addition, the separating material of the present invention can be cured without using an ultraviolet ray. Therefore, the blood test can be carried out without adverse influence of the ultraviolet ray, and further it is possible to conduct sterilization procedure by irradiation with ultraviolet ray or γ-ray.

The invention claimed is:

1. A blood collection tube comprising a serum or plasma separating material comprising a moisture curing component having a specific gravity of from 1.03 to 1.09.

2. The blood collection tube according to claim 1, wherein the moisture curing component contains at least one material selected from the group consisting of a reactive silicone-based compound, an α-cyanoacrylate-based compound and a one component moisture curing polyurethane resin.

3. The blood collection tube according to claim 1, wherein the serum or plasma separating material further comprises a reinforcing material.

4. The blood collection tube according to claim 3, wherein the reinforcing material is at least one material selected from the group consisting of a polystyrene, a polyurethane, an acrylic resin, a polyolefin and a silicone resin.

5. The blood collection tube according to claim 3, wherein the reinforcing material is contained in an amount of from 2 to 900 parts by mass on the basis of 100 parts by mass of the moisture curing component.

6. The blood collection tube according to claim 4, wherein the reinforcing material is contained in an amount of from 2 to 900 parts by mass on the basis of 100 parts by mass of the moisture curing component.

7. The blood collection tube according to claim 1, wherein the serum or plasma separating material further comprises a blood isolating material.

8. The blood collection tube according to claim 7, wherein the blood isolating material is a capsule in which at least the moisture curing component is enclosed.

9. The blood collection tube according to claim 8, wherein the capsule is formed of a film.

10. The blood collection tube according to claim 7, further comprising a high-specific gravity solid.

11. The blood collection tube according to claim 8, further comprising a high-specific gravity solid.

12. The blood collection tube according to claim 9, further comprising a high-specific gravity solid.

13. The blood collection tube according to claim 10, wherein the high-specific gravity solid is disposed in the vicinity of the blood isolating material.

14. The blood collection tube according to claim 11, wherein the high-specific gravity solid is disposed in the vicinity of the blood isolating material.

15. The blood collection tube according to claim 12, wherein the high-specific gravity solid is disposed in the vicinity of the blood isolating material.

16. The blood collection tube according to claim 10, wherein the high-specific gravity solid has a specific gravity of from 1.1 to 15.0.

17. The blood collection tube according to claim 13, wherein the high-specific gravity solid has a specific gravity of from 1.1 to 15.0.

18. The blood collection tube according to claim 10, wherein the high-specific gravity solid is made of a plastic material, a ceramic material or a metal.

19. The blood collection tube according to claim 13, wherein the high-specific gravity solid is made of a plastic material, a ceramic material or a metal.

20. The blood collection tube according to claim 16, wherein the high-specific gravity solid is made of a plastic material, a ceramic material or a metal.

* * * * *